US005170945A

United States Patent [19]

Daly et al.

[11] Patent Number: 5,170,945

[45] Date of Patent: Dec. 15, 1992

[54] FUEL INJECTOR THAT SWIRLS AND THROTTLES THE FLOW TO CREATE TO A TOROIDAL FUEL CLOUD

[75] Inventors: Paul D. Daly, Troy; Mark A. Brooks, Sterling Heights; Robert E. Fallis, Milford, all of Mich.

[73] Assignee: Siemens Automotive L.P., Auburn Hills, Mich.

[21] Appl. No.: 805,403

[22] Filed: Dec. 10, 1991

[51] Int. Cl.[5] ..... F02M 51/06; F02M 61/13

[52] U.S. Cl. ..... 239/585.4; 239/497; 251/129.22; 251/205

[58] Field of Search ..... 239/585.4, 585.5, 487, 239/491, 497, 533.12; 251/129.22, 129.15, 205

[56] References Cited

U.S. PATENT DOCUMENTS 4,564,145 1/1986 Takada et al. ..... 239/585.4
4,805,837 2/1989 Brooks et al. ..... 239/585.4
4,877,187 10/1989 Daly ..... 239/585.4
4,887,769 12/1989 Okamoto et al. ..... 239/585.4
4,971,254 11/1990 Daly et al. ..... 239/533.12

*Primary Examiner*—Andres Kashnikow
*Assistant Examiner*—Karen B. Merritt
*Attorney, Agent, or Firm*—George L. Boller; Russel C. Wells

[57] ABSTRACT

The fuel injector has several swirl passages in a fuel swirl and needle guide member that direct swirl fuel onto the frusto-conical surface of a valve seat member that is disposed at the injector's nozzle end. The needle lift is such that with the needle unseated to open the injector to flow, the swirl fuel is throttled as it passes between the rounded tip end of the open needle and the frusto-conical surface of the seat member. The throttling tends to spread the swirl flow so that it is more uniform in the circumferential sense. If the injector is closed before equilibrium flow occurs, a toroidal shaped fuel cloud is created; if the injector is closed after equilibrium flow occurs, an ellipsoidal shaped fuel cloud is created.

11 Claims, 2 Drawing Sheets

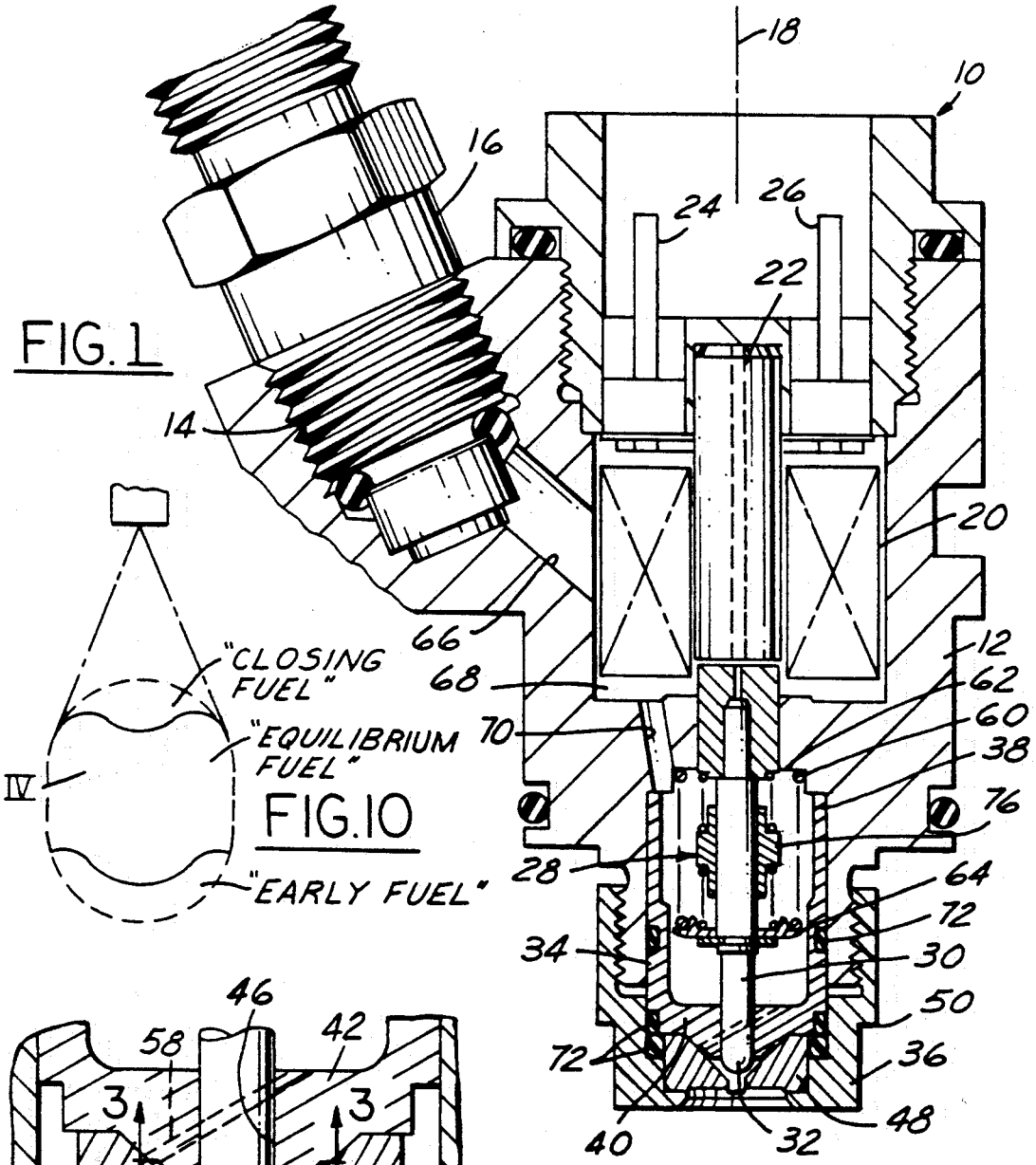
FIG. 1
FIG. 10
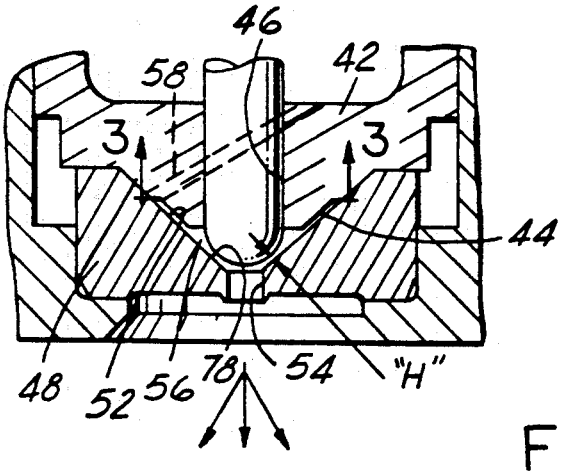
FIG. 2
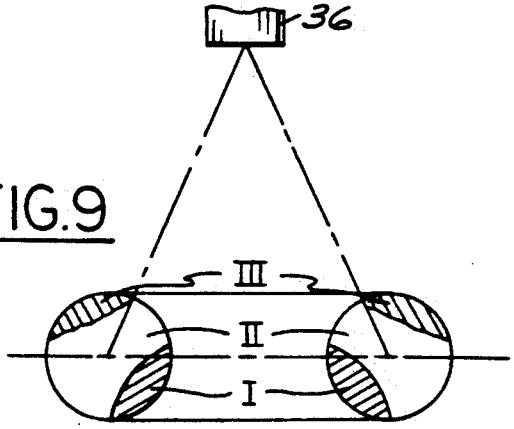
FIG. 9

FUEL INJECTOR THAT SWIRLS AND THROTTLES THE FLOW TO CREATE TO A TOROIDAL FUEL CLOUD

FIELD OF THE INVENTION

This invention relates to electrically operated fuel injectors for internal combustion engines.

BACKGROUND AND SUMMARY OF THE INVENTION

Known electrically operated fuel injectors which impart a swirling component of motion to the fuel being injected place the largest portion of the pressure drop across the swirl-inducing device. Such fuel injectors either retain a relatively large volume of "dead" or non-swirl fuel below the swirl-inducing device or else place the swirl-inducing device downstream of the valve seat where the possibility of objectionable post-injection drip may exist. In either case, the quality of the injection may be compromised by the introduction of a certain amount of non-swirl fuel into the combustion chamber. Accordingly, there is room for further improvement in enhancing the swirling character of an injected fuel cloud.

In order for a spark-ignited internal combustion engine to exhibit acceptable part throttle (part load) operation, it has been found important that a fuel injector create a finely atomized cloud of fuel that is distributed over a large extent of the combustion chamber volume close to, but preferably not colliding with, the combustion chamber walls.

The present invention is directed toward a novel fuel injector that operates to enhance the swirling character of the injected fuel cloud. It has been discovered that the invention can create an injected fuel cloud which possesses a distinctly toroidal shape. Such discovery has been made and measured through the use of sophisticated photo-optical techniques including stroboscopic photography, helium-neon laser beam diffraction, and principles including Fraunhofer diffraction. As engine speed increases, it is desirable that the injected fuel cloud become increasingly spaced from the combustion chamber wall. By having a small dead-volume, a fuel injector according to the present invention is especially suitable for high-speed operation such as that which can occur in a two-stroke engine, and in such case, the fuel injector is supplied with fuel which is pressurized to a pressure that is considerably higher than that customarily used in today's fuel injection systems for four-stroke engines. Additionally, the invention is capable of producing a relatively circumferentially uniform swirl in the injected fuel from a limited number of circumferentially separated swirl passages in the swirl inducing device.

Further features, advantages, and benefits will be found in and perceived from the ensuing detailed description of a presently preferred embodiment of the invention. Drawings accompany the disclosure and illustrate the presently preferred embodiment in the best mode contemplated at this time for carrying out the invention.

BRIEF DESCRIPTION OF THE DRAWINGS

FIG. 1 is a longitudinal cross section through a fuel injector embodying principles of the invention.

FIG. 2 is an enlarged view in the vicinity of the outlet of the fuel injector of FIG. 1.

FIG. 9 is a schematic depiction of a toroidal fuel cloud that is produced by a fuel injector according to principles of the invention.

FIG. 10 is a schematic depiction of an ellipsoidal fuel cloud that is produced by a fuel injector according to principles of the invention.

DESCRIPTION OF THE PREFERRED EMBODIMENT

Figure 3:
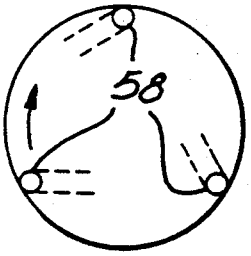
FIG. 3 is a view in the direction of arrows 3—3 in FIG. 2.

FIGS. 1-3 illustrate a fuel injector 10 that is in some respects similar to that described in commonly assigned U.S. Pat. No. 4,805,837. Fuel injector 10 comprises a housing 12 having an inlet 14 to which is connected a fitting 16 through which high pressure fuel is delivered to the fuel injector. Reference numeral 18 designates the main longitudinal axis of the fuel injector. Disposed within housing 12 coaxial with axis 18 are a solenoid coil 20 and a stator 22. Electric terminals 24, 26 are made externally accessible to provide for electrical connection of the solenoid to wires of a wiring harness (not shown) which connect the fuel injector to an engine management computer (not shown) for operating the fuel injector. Axially aligned with stator 22 and guided on housing 12 for longitudinal stroking is an armature assembly 28. Assembly 28 includes a needle valve member 30 having a distal rounded tip end 32. Guidance of member 30 is provided in part by a needle guide and swirl member 34 which is coaxially internally received in housing 12 at the outlet end 36 of the fuel injector.

Member 34 comprises a circular cylindrical side wall 38 and a transverse end wall 40 at its distal end. End wall 40 contains a centrally disposed protrusion 42 whose general shape is that of a frustum of a cone that points away from the end wall in the direction opposite the direction from which side wall 38 extends from the end wall. The O.D. of protrusion 42 contains at its distal end a circumferentially continuous groove 44 whose radial dimension is noticeably smaller than its dimension along the direction of the conical directrix defining protrusion 42. A circular coaxial through-hole 46 in the member provides guidance for needle valve member 30 just proximally of tip end 32.

The fuel injector further includes a valve seat member 48 that is disposed within housing 12 coaxial with member 34 between member 34 and a tubular-shaped end cap 50 that forms outlet end 36. Valve seat member 48 contains a central coaxial depression 52 within which protrusion 42 nests. Depression 52 comprises a frustoconical shaped wall surface that necks down to a circular coaxial outlet hole 54 through which injected fuel is emitted from the fuel injector.

The two members 34 and 48 are held in end-to-end abutment by the threading of cap 50 onto housing 12 and co-operatively define between themselves a swirl chamber space 56. End wall 40 also contains three swirl passages 58 that extend from the axially upstream face of the end wall to its axially downstream face which confronts depression 52. Each swirl passage 58 is in the form of a straight circular hole whose axis is skew to axis 18. The swirl passages are arranged in a uniform pattern one hundred and twenty degrees apart about axis 18. (See FIG. 3 also.) The inlet of each swirl hole 58 is at the upstream face of end wall 40 while the outlet is at the upper edge of groove 44.

The internal mechanism of the injector also comprises a helical spring 60 that is disposed between an internal shoulder 62 of housing 12 and a disc 64 which forms a part of armature assembly 28. Spring 60 acts to resiliently bias armature assembly 28 such that tip end 32 is forced to seat on depression 52 and close the internal fuel path through the fuel injector to flow. (The drawings show the unseated position.)

The internal fuel path comprises a slant passage 66 leading from inlet fitting 16 to space 68 surrounding solenoid coil 20 and one or more passages 70 leading from space 68 to space that is bounded by the side and end walls of member 34. There are several seals, 72 generally, for internally sealing between the parts, as shown. A damping mechanism 76 is also associated with armature means 28 for imparting viscous shear damping to the motion of the armature means.

Figure 5:
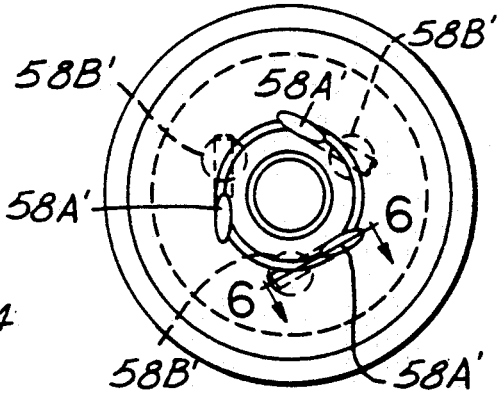
FIG. 5 is a view in the same direction as FIG. 3 illustrating a modified form.
Figure 6:
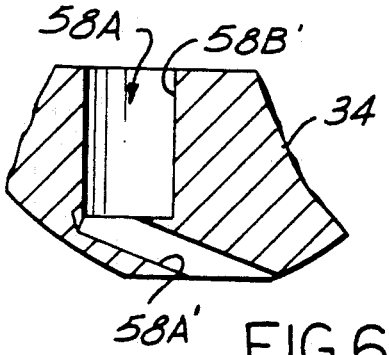
FIG. 6 is an enlarged fragmentary cross section in the direction of arrows 6—6 in FIG. 5.

FIGS. 5 and 6 show an alternate form of swirl passage 58A which is composed of a skew segment 58A' and an axial segment 58 B'. This modified form may be used where it is necessary for a given thickness (axial dimension) of end wall 40 that the radial dimension of member 34 also be limited such that the swirl passage cannot be made straight throughout because of the need for the swirl passage to intersect the surface of depression 52 at a certain angle. In this regard, it should be pointed out that the flow exiting a swirl passage should be directed toward the surface of depression 52 in the general sense depicted in the drawings for best results.

The fuel injector is operated by repetitively energizing solenoid coil 20 with electrical pulses. The pulses are duty-cycle modulated to control the duration for which the fuel injector is open. The application of a pulse causes armature means to unseat tip end 32 from contact with the surface of depression 52 and thereby open the flow path through the fuel injector to flow. For illustrative purposes, the drawings show tip end 32 unseated from the surface of depression 52, and when it is seated, it makes contact with a circular seating zone 78 on the surface of depression 52. When tip end 32 is unseated, the reference "H" designates the minimum distance between seating zone 78 and tip end 32, and hence represents the extent to which the fuel injector is open at any given instant of time. The drawings may exaggerate the amount of opening for illustrative purposes. The maximum extent to which the fuel injector can open is determined by the stroke of the armature means, and in the illustrated fuel injector the stroke is limited by abutment of armature means 28 with the end of stator 22. When a coil-energizing pulse terminates, spring 60 and the high fuel pressure force the tip end 32 to re-seat on seating zone 78 thereby closing the fuel injector.

In accordance with principles of the invention, the total flow area for fuel to enter swirl chamber space 56 by passing from the upstream face to the downstream face of needle guide and fuel swirl member 34 is greater than the flow area for fuel to pass between tip end 32 and seating zone 78 for all positions of valve member 30 along its stroke, and the flow area for fuel to exit the swirl chamber space by passing from the fuel injector's outlet is greater than that for fuel to pass between tip end 32 and seating zone 78 for all positions of the valve member along its stroke. The result is that the fuel flow through the injector is always throttled by the restriction that exists between tip end 32 and seating zone 78. Such throttling acts upon the swirl flow that has been introduced into the swirl chamber space from swirl passages 58 to create a smoothing effect on the three discrete swirl flows. This is shown by FIGS. 7 and 8.

Figure 7:
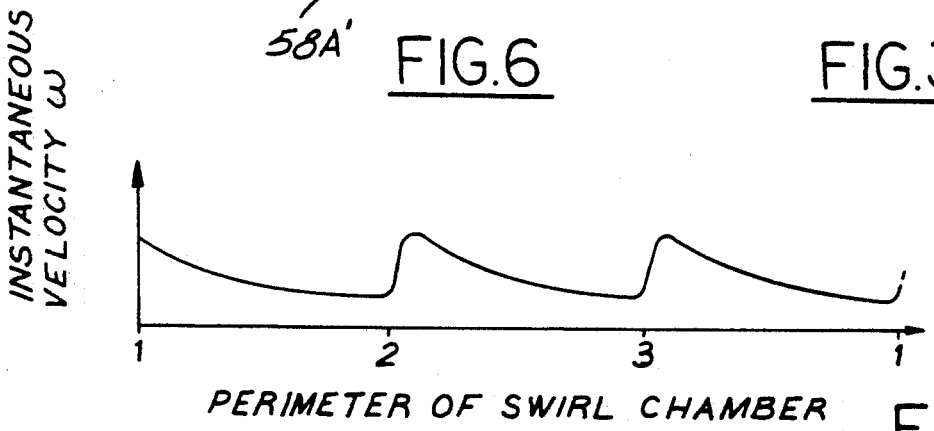
FIGS. 7 and 8 are diagrams illustrating how a fuel injector according to the invention creates a relatively circumferentially uniform swirl in the injected fuel from a limited number of circumferentially separated swirl passages.
Figure 8:
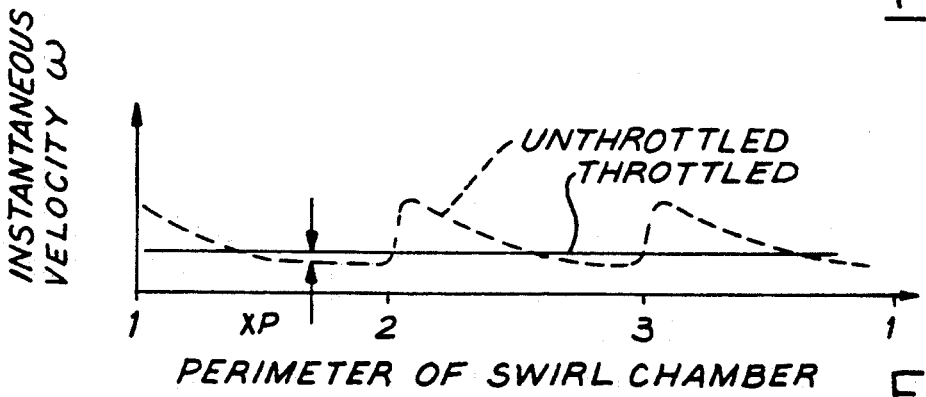

FIG. 7 shows the instantaneous fuel velocity as a function of its circumferential location around the swirl chamber in the absence of such throttling. The horizontal axis of FIG. 7 represents the circumferential location, with the numbers 1, 2, 3 representing the outlets of the three swirl passages. The straight solid horizontal line in FIG. 8 shows the ideal objective of such throttling. In actual practice, it is possible to approach this ideal, but such a plot for an actual valve will not be a perfectly straight horizontal line. In any event, an actual plot will be a distinct improvement over an unthrottled flow. The throttling is effective to spread the discrete flows in the circumferential sense, and this is important in attaining the distinctly toroidal shape of an injected fuel cloud.

Operation of a representative fuel injector for producing such a toroidal fuel cloud will now be described. An idealized toroidal shaped cloud is illustrated in FIG. 9.

The injector is supplied with high pressure fuel (approximately 1,000 psi). Assume that the operation begins with the fuel injector closed. The application of an energizing pulse to the solenoid coil will cause the armature means to move and begin unseating tip end 32 from seating zone 78. At 0.200 milliseconds into the pulse, the distance "H" may be approximately 0.000001 inch. Initially, the only fuel that can exit the injector is whatever residual fuel has been retained by surface tension in the volume below seating zone 78. Clearly that fuel will exit axially without a circumferential velocity component, but its volume is quite small. Further into the pulse, the increasingly opening fuel injector will replace the exited fuel with fuel that had been occupying the swirl chamber space in the volume between member 58 and "H". This fuel also lacks any substantial angular velocity since it has not recently come through the swirl passages. Hence it exits the injector in an axial but divergent path, such divergence being attributable to the high pressure acting on the fuel. This volume is also comparatively small, but its existence can be detected as a small "spike" that moves rapidly away from the injector. At this time, the pulse is about 0.256 milliseconds old.

At a later time which may be approximately 0.47 milliseconds into the pulse, the armature means collides with the stator. The injector may now be considered fully open with fuel flowing freely through the swirl passages into the swirl chamber space. The volume flow is just large enough to allow the fuel to begin achieving a homogenous angular velocity. However, a volume flow which is large enough to achieve a completely homogeneous angular velocity is impractical because it is also the "dead volume" and would increase the amount of non-swirl fuel that is discharged between 0.20 and 0.47 milliseconds into the pulse. The partially homogeneous swirling fuel is now throttled as it passes through the restriction between tip end 32 and seating zone 78. This has the effect of homogenizing the swirl so that the angular velocity is more uniform around the resultant spray, as mentioned above in connection with FIG. 8.

The fuel that flows during the time between 0.256 and 0.47 milliseconds into the pulse is also significant. This fuel is of a range of angular velocities because of the inertia of the fuel and the moving geometry of the swirl chamber. This fuel moves rapidly away from the injector, diverging quickly, but initially with lower angular velocity (due to the throttling at low armature lift) and more homogeneity. This "early fuel" forms the lower center of a distinctively toroidal injected fuel cloud, as depicted by the numeral I in FIG. 9. Later after 0.47 milliseconds, the angular velocity of the swirling fuel is greater since flow full velocity equilibrium has then been achieved, and consequently, there is greater divergence at that time. This "later fuel" forms the outside and top of the toroidal fuel cloud, as depicted by the numeral II in FIG. 9. It also has smaller SMD (Sauter Mean Diameter) since throttling is less pronounced than it was earlier.

Completion of the creation of the toroidal shaped injected fuel cloud is achieved by closing the fuel injector before the flow through the valve achieves a steady state condition. When the energizing pulse applied to the solenoid coil ceases, the injector begins to close. As the needle valve approaches the seating zone, the pressure rises revealing the creation of a "water-hammer" effect, meaning that as the fuel flow through the swirl passages is increasingly restricted by the closing motion, the pressure rises due to the inertia of the moving fuel and the principles of the conservation of energy. The result is that the very last portion of the fuel cloud is subject to a greater pressure drop, and hence it forms smaller droplets in the injected fuel cloud. (Smaller SMD). It is also the result of greater throttling and therefore greater homogeneity, demonstrated by the small value of SPAN that has been obtained through laboratory measurements. This "closing fuel" forms the very top and last portion of the toroidal fuel cloud as depicted by the numeral III in FIG. 9.

At small pulse widths, such as occur at engine idle and light load, a similar set of conditions occurs but their relative proportions change. For example: A) The fuel pressure is never at equilibrium. This has the effect of producing a fuel cloud that is of a range of angular velocities even when the mechanical parts of the injector are in equilibrium (i.e. stationary). Consequently, the cloud is of a variety of different diameters at any given distance from the injector outlet, but nonetheless causing a distinctly toroidal shaped fuel cloud. B) The proportion of time that the mechanical parts are in motion becomes greater as the pulse width decreases. For example, at wide open throttle and 1.7 millisecond pulse width, the opening motion is 16.1%, but at idle and pulse width 0.65 milliseconds, the opening motion is 42%. The effect on angular velocity is a greater homogeneity due to more time at more pronounced throttling conditions; velocity of propagation is less and the fuel cloud is almost exclusively a toroid since no equilibrium spray is ever attained. It should be understood that the depiction of FIG. 9 is schematic, and that an actual cloud is unlikely to be ideal; however, a distinctive generally toroidal shape can be seen in actual practice.

If the fuel injector is left open long enough to achieve flow equilibrium (i.e., steady state flow) that is allowed to endure for a certain limited amount of time, then the injected fuel forms into an ellipsoidal shape, rather than a toroidal one. The portion of the fuel cloud resulting from equilibrium flow is designated by the numeral IV in FIG. 10. At a time, approximately 0.596 milliseconds after the first fuel flow has started, a state of pressure equilibrium is achieved inside the injector so that fuel flows at a generally steady-state velocity through the swirl holes, achieves a steady but non-homogeneous angular velocity, and is throttled whereby a more uniform velocity is achieved forming a swirl patterned cloud, still numeral IV in FIG. 10. This "equilibrium fuel" merges with the part of the cloud created by the "early fuel" which is now the lower center of an ellipsoid cloud. The "equilibrium fuel" that is injected after equilibrium has been attained takes over after the initial formation of the bottom and lower side of the toroidal shape and creates a generally ellipsoidal shaped cloud which is much larger in expanse than the toroidal cloud. Such a general ellipsoidal shaped cloud appears in FIG. 10. As the fuel injector is closing, the "closing fuel" completes the upper side and top of the generally ellipsoidal shaped fuel cloud. It should be understood that the depiction of FIG. 10, like that of FIG. 9, is schematic, and that an actual cloud is unlikely to be ideal; however, a distinctive generally ellipsoidal shape can be seen in actual practice.

Whenever the injector is operated closed before the equilibrium flow is attained, the domination of the fuel cloud by the equilibrium fuel spray (numeral IV in FIG. 10) does not occur because the top and upper sides of the ellipsoid are not created and therefore cannot merge with the initial toroid.

Figure 4:
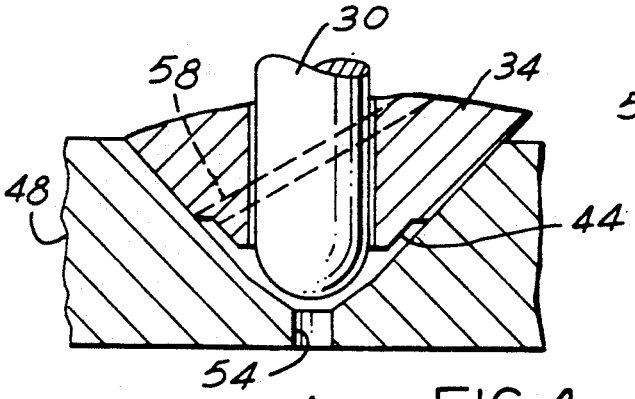
FIG. 4 is an enlarged view illustrating a modified form of FIG. 2.

FIG. 4 illustrates an embodiment wherein the seat member 48 has a dual-slope frusto-conical surface which is nominally on a fourty-five degree cone like the embodiment of FIGS. 1 and 2, but becomes a sixty degree slope proximate outlet hole 54. In this embodiment the rounded tip end of the needle seats on the sixty degree slope portion.

While a presently preferred embodiment of the invention has been illustrated and described, principles are applicable to other embodiments. For example while two particular patterns of uniform swirl holes have been illustrtated other uniform patterns are possible, and in fact some degree of non-uniformity in the patterns may not seriously degrade the ability of the fuel injector to create the desired result with the disclosed throttling effect.

What is claimed is:

1. A fuel injector comprising a valve body having a main longitudinal axis and comprising an inlet via which pressurized liquid fuel is introduced into said valve body, a valve seat member comprising a frusto-conical surface containing a valve seat and circumscribing a fuel outlet, a fuel path extending through said valve body between said inlet and said outlet, a needle guide and fuel swirl member disposed within said valve body and comprising an axially upstream face that is toward said inlet and an axially downstream face that is toward said outlet, said needle guide and fuel swirl member's axially downstream face cooperating with said valve seat member to define a swirl chamber space, an electrically operated mechanism disposed on said valve body and comprising an axially reciprocal armature means and bias means for axially reciprocating over a given stroke a needle valve member that passes through a guide hole in said needle guide and fuel swirl member and has a tip end confronting said seat member such that said tip end is seated on and unseated from said valve seat to close and open said fuel path, said needle guide and fuel swirl member comprising plural swirl passages extending through said needle guide and fuel swirl member between said axially upstream and downstream faces thereof in directions that are skew to said axis and opening at said downstream face of said needle guide and fuel swirl member toward said frusto-conical surface in spaced upstream relation to said valve seat such that fuel exiting said swirl passages flows with a circumferential component of motion about said axis as it passes through said swirl chamber space toward said outlet, the total flow area for fuel to enter said swirl chamber space by passing from said upstream face to said downstream face of said needle guide and fuel swirl member being greater than the flow area for fuel to pass between said tip end of said needle valve member and said valve seat for all positions of said needle valve member along its stroke, and the flow area for fuel to exit said swirl chamber space by passing through said outlet being greater than that for fuel to pass between said tip end of said needle valve member and said valve seat for all positions of said needle valve member along its stroke.

2. A fuel injector as set forth in claim 1 including means for operating said mechanism such that after said needle valve member has been open-stroked, it is closed-stroked before a steady-state flow through the injector is attained.

3. A fuel injector as set forth in claim 1 in which said needle guide and fuel swirl member seats on said seat member, said two members have confronting frusto-conical surfaces, said needle guide and fuel swirl member comprises a circumferential groove in its frusto-conical surface proximate the locations where said fuel swirl passages open to said swirl chamber space.

4. A fuel injector as set forth in claim 3 in which said groove has a smaller dimension in the radial sense than it does in the frusto-conical sense.

5. A fuel injector as set forth in claim 1 in which said swirl passages are straight throughout.

6. A fuel injector as set forth in claim 1 in which said swirl passages comprise an axial portion that is parallel to said axis and a skew portion downstream of said axial portion and skew to said axis.

7. A fuel injector as set forth in claim 6 in which said skew portion individually is straight.

8. A fuel injector comprising a valve body having a main longitudinal axis and comprising an inlet via which pressurized liquid fuel is introduced into said valve body, a valve seat member comprising a frusto-conical surface containing a valve seat and circumscribing a fuel outlet, a fuel path extending through said valve body between said inlet and said outlet, a fuel swirl member disposed within said valve body and comprising an axially upstream face that is toward said inlet and an axially downstream face that is toward said outlet, said needle guide and fuel swirl member's axially downstream face cooperating with said valve seat member to define a swirl chamber space, an electrically operated mechanism disposed on said valve body and comprising armature means and bias means for operating a valve member to seat on and unseat from said valve seat to close and open said fuel path, said fuel swirl member comprising plural swirl passages extending therethrough for conveying fuel from said inlet to said swirl chamber space in directions that are skew to said axis and opening toward said frusto-conical surface in spaced upstream relation to said valve seat such that fuel exiting said swirl passages flows with a circumferential component of motion about said axis as it passes through said swirl chamber space toward said outlet, and means for operating said fuel injector such that during opening of said valve member the circumferential component of flow of fuel exiting said outlet is allowed to increase and such that said valve member is operated from open to closed before a steady state flow is attained to cause the circumferential component of flow to decrease wherein the result of such opening and closing of the valve member produces a fuel cloud that has a generally toroidal shape whose existence is confirmed by stroboscopic light evaluation of the fuel exiting the injector outlet.

9. A fuel injector as set forth in claim 8 including means for operating said fuel injector such that after opening, said valve member is operated from open to closed sufficiently after a steady state flow is attained to create an ellipsoidal shaped fuel cloud whose existence is confirmed by stroboscopic light evaluation of the fuel exiting the injector outlet.

10. A fuel injector comprising a valve body having a main longitudinal axis and comprising an inlet via which pressurized liquid fuel is introduced into said valve body, a valve seat member comprising a frusto-conical surface containing a valve seat and circumscribing a fuel outlet, a fuel path extending through said valve body between said inlet and said outlet, means to define a swirl chamber space within which the fuel is swirlled before it leaves the fuel injector, an electrically operated mechanism disposed on said valve body and comprising armature means and bias means for operating a valve member to seat on and unseat from said valve seat to close and open said fuel path, operating means for operating said fuel injector to selectively produce a toroidal shaped fuel cloud or an ellipsoidal shaped fuel cloud, said operating means comprising means for operating said fuel injector such that after one opening said valve member is operated from open to closed before a steady state flow is attained to create a fuel cloud that has a generally toroidal shape whose existence is confirmed by stroboscopic light evaluation of the fuel exiting the injector outlet, and means for operating said fuel injector such that after another opening, said valve member is operated from open to closed sufficiently after a steady state flow is attained to create an ellipsoidal shaped fuel cloud whose existence is confirmed by stroboscopic light evaluation of the fuel exiting the injector outlet.

11. A fuel injector as set forth in claim 10 in which the creation of a toroidal shaped fuel cloud is correlated with idle and low speed engine operation and the creation of an ellipsoidal shaped fuel cloud is correlated with higher speed engine operation.

* * * * *